US007372014B1

(12) United States Patent
Stebbins et al.

(10) Patent No.: US 7,372,014 B1
(45) Date of Patent: May 13, 2008

(54) CORROSION-PROOF POOL DECK CONNECTOR SYSTEM

(75) Inventors: Michael S. Stebbins, Grand Rapids, MI (US); James E. Crouch, Grand Rapids, MI (US)

(73) Assignee: Industrial Service Technology, Inc., Grand Rapids, MI (US)

( * ) Notice: Subject to any disclaimer, the term of this patent is extended or adjusted under 35 U.S.C. 154(b) by 560 days.

(21) Appl. No.: 10/947,725

(22) Filed: Sep. 23, 2004

(51) Int. Cl.
*E04H 4/00* (2006.01)
*G04F 8/00* (2006.01)

(52) U.S. Cl. ..... 250/221; 250/227.11; 385/100; 340/309.16; 340/323 R; 200/52 R; 4/488; 4/496; 377/5; 368/110; 368/113

(58) Field of Classification Search ..... 250/221, 250/227.11; 385/100; 368/110, 113; 340/323 R, 340/309.16; 200/510–512, 52 R; 4/496, 4/488; 377/5, 24.2
See application file for complete search history.

(56) References Cited

U.S. PATENT DOCUMENTS 3,784,768 A 1/1974 Hunt
3,944,763 A 3/1976 Beierwaltes
4,700,369 A 10/1987 Siegal et al.
5,349,569 A * 9/1994 Tanaka ..... 368/10
5,702,799 A 12/1997 Brown et al.
5,812,049 A * 9/1998 Uzi ..... 340/323 R
5,959,433 A 9/1999 Rohde
6,072,751 A * 6/2000 Kirson et al. ..... 368/2
6,156,987 A 12/2000 Warne
6,398,397 B1 * 6/2002 Koren ..... 362/562
6,657,351 B2 12/2003 Chen et al.
7,015,458 B2 * 3/2006 Endicott ..... 250/227.21
7,029,170 B2 * 4/2006 Bailey ..... 368/276
7,119,799 B2 * 10/2006 Kaski ..... 345/173

* cited by examiner

*Primary Examiner*—Davienne Monbleau
(74) *Attorney, Agent, or Firm*—McGarry Bair PC

(57) ABSTRACT

A poolside connector system and method for use with swimming pool race timing systems and signaling devices. A deck plate or similar poolside signal junction is provided with an optical receiver terminal, and a cable connection from a poolside signaling device such as a touchpad or backup button is provided with an optical transmitter terminal that can be plugged into the deck plate terminal. Electrical signals from the touchpad and backup button representing completed laps are transmitted as optical signals to the deck plate junction. The optical connection at the deck plate is non-conductive and electrically sealed from the poolside environment, and thus has no exposed electrical terminals to corrode. The low voltage DC current on which the optical terminals operate is provided in sealed fashion to the electrically insulated optical terminals, in a preferred form via an inductive power coupling whose halves are sealed in the deck plate and the removable cable connection.

17 Claims, 5 Drawing Sheets

CORROSION-PROOF POOL DECK CONNECTOR SYSTEM

FIELD OF THE INVENTION

The present invention is in the field of swimming pool deck connectors of the type used for connecting the various poolside timing components of a swim-race timing system.

BACKGROUND OF THE INVENTION

Electronic timing systems are commonly used for pool swimming races, with the recording of swimmers' start times, lap times (often referred to as split times), and finish times commonly being triggered by switches known as "touchpads". Referring to FIGS. 1 and 1A, the touchpads are typically large, flat panels 16 mounted underwater against the end wall 14 of pool 10 at the end of each swimming lane 12, positioned for a swimmer to make switch-closing contact with his hands or feet at the end of each lap. The touchpads 16 receive switch-operating power from a timing system 30 located near the pool, and send timing signals through permanent "deck plate" outlets 20 connected by buried conduit 21 to the timing system 30.

An alternative to the permanent deck plate arrangement is a temporary deck cable (not shown, but well known) with touchpad and backup button connections similar to those in the deck plates. For illustration, the deck cable corresponds to buried conduit 21 in FIG. 1, but lies temporarily on the surface of the pool deck 18 and is removed when the race event is over. The touchpad, backup button, and any other auxiliary device connections on the deck cable correspond in placement and function to the connections in deck plates 20, but are spliced into the cable without the need for a rigid mounting structure, and are removed along with the cable at the end of the race event.

The timing system 30, illustrated schematically as a timing "box" or controller 32 located at the pool "office" 34 (often an elevated timing table with assorted printers, displays, power source, controls, the timing box and computer) associates a start time, split time, or final time with each hit, and records and displays the times, for example transmitting them to scoreboard 38 via conduit 31. To make sure that each swimmer's times are recorded in the event of a missed or faulty touchpad hit, it is common to have a human timer (FIG. 1A) on the pool deck 18 holding a manually-operated "backup button" switch 22, which is plugged into a corresponding touchpad's deck plate 20 to deliver a "hit" signal to the timing system similar to that provided by the touchpad.

The deck plates 20 often have auxiliary power/data connections for speakers, lights, horns, and other peripheral devices shown schematically at 36, allowing information to be communicated from the timing system back to the swimmers poolside.

The typical deck plate 20 is mounted flush in the concrete pool deck 18 adjacent each swimming lane 12. Touchpad 16 and backup button 22 are connected to deck plate 20 through cables 16*a* and 22*a* ending in plugs 16*b* and 22*b* plugged into deck plate outlets 20*b*. Plugs 16*b* and 22*b* and deck plate outlets 20*b* have mating metal electrical terminals 16*c*, 22*c* and 20*c*. Swim race timing systems are typically powered by low voltage DC electrical current, usually on the order of 5VDC, so any exposed or water-shorted metal plug connections are safe. But the pool deck 18 is usually awash in chlorinated water, which quickly corrodes the metal terminals 20*c* in the deck plates. Frequent cleanings of deck plate terminals 20*c* to prevent corrosion and maintain connection quality usually make the problem worse, by abrading or chemically damaging the metal terminal surfaces. Even temporary deck cable terminals can suffer corrosion, although with some effort corrosion can be minimized by removing the cables and drying their terminals between meets.

Another problem with prior poolside timing system connectors is the need to supply electrical current to the switch-closing contacts in the touchpads and backup buttons. Direct (DC) current tends to increase corrosion of the conductive surfaces, such that at least one prior patent has suggested using voltages as low as 0.25 VDC for the touchpads to reduce corrosion of the conductive metal touchpad surfaces. The lower the DC voltage, however, the greater the line losses through the relatively small gauge wire connecting the various timing system components using that voltage, and the more the system is susceptible to noise.

BRIEF SUMMARY OF THE INVENTION

According to the invention, a connector system for a poolside race timing system comprises a photoelectric signal receiving junction located at an exposed portion of the pool deck adjacent a swimming lane, the signal receiving junction comprising a first photo-receiver plug terminal being electrically connected to a race timing system. A poolside signal generating device is associated with the swimming lane and comprises a low-voltage direct current circuit and the poolside signal generating device further comprises a switch from closing the low voltage direct-current circuit. The poolside signal generating device has a temporary cable connection to the signal receiving junction and the cable connection includes a photo transmitter plug terminal with an associated photo-transmitter device powered by low voltage direct current in response to the switch closing the low-voltage direct current circuit and is electrically sealed from the poolside environment. The photo-transmitter plug terminal is temporarily matable with the photo-receiver plug terminal at the signal receiving junction to deliver an optical signal to the photo receiver plug terminal at the signal receiving junction in response to the closing of the signal generating device switch.

In one embodiment, the signal receiving junction comprises a deck plate. Further, the signal receiving junction can comprise a deck cable as well as a touch pad and a backup button.

In another embodiment, the low voltage direct current for the photo transmitter device is derived from a non-conductive power coupling between the photo receiver plug terminal and the photo transmitter plug terminal at the signal receiving junction when the plug terminals are mated. Further, the non-conductive power coupling can comprise and inductive coupling with a transmitting portion in the signal receiving junction and a receiving portion in the photo-transmitter plug terminal. Still further, the inductive power coupling can comprise a transmitter coil in the signal receiving junction associated with the photo receiving plug terminal, and a receiving coil in the photo transmitter plug terminal. In a preferred embodiment, the inductive power coupling comprises a DC-AC inverting circuit in the signal receiving junction and an AC-DC converting circuit in the photo transmitting plug terminal. In addition, the DC-AC inverting circuit in the signal receiving junction can include an oscillator circuit, and the AC-DC converting circuit can include a rectifying circuit. Further, the rectifying circuit can include a charging capacitor.

In another embodiment, the photo receiver-device in the signal receiving junction and the photo-transmitter device of the photo-transmitter plug terminal are powered by low voltage direct electrical current from the race timing system.

In another embodiment, the photo receiver device in the signal receiving junction is powered by low voltage direct electrical current from the race timing system, and the photo-transmitter device of the photo transmitting plug terminal is powered by a battery associated with the poolside signal device.

Further according to the invention, a method for transmitting signals from poolside signal devices to a race timing system in a pool deck comprises generating an electrical signal at the poolside signal device, converting the electrical signal to a corresponding optical signal, and transmitting the optical signal across a temporary, non-conductive optical plug connection at an exposed portion of the pool deck to a photo-receiver in a sealed signal receiving junction at the exposed portion of the pool deck connected to the race timing system.

In one embodiment, the method further includes converting the optical signal received by the photo receiver to an electrical system readable by the race timing system. In another embodiment, the method further comprises supplying electrical power to the poolside signal device for the electrical signal through the non-conductive optical connection at the pool deck. Further, the method can include supplying the electrical power through the non-conductive optical connection at the pool deck with an inductive coupling.

These and other features and advantages of the invention will become apparent upon further reading of the specification, in light of the accompanying drawings.

DETAILED DESCRIPTION OF THE INVENTION

Figure 1:
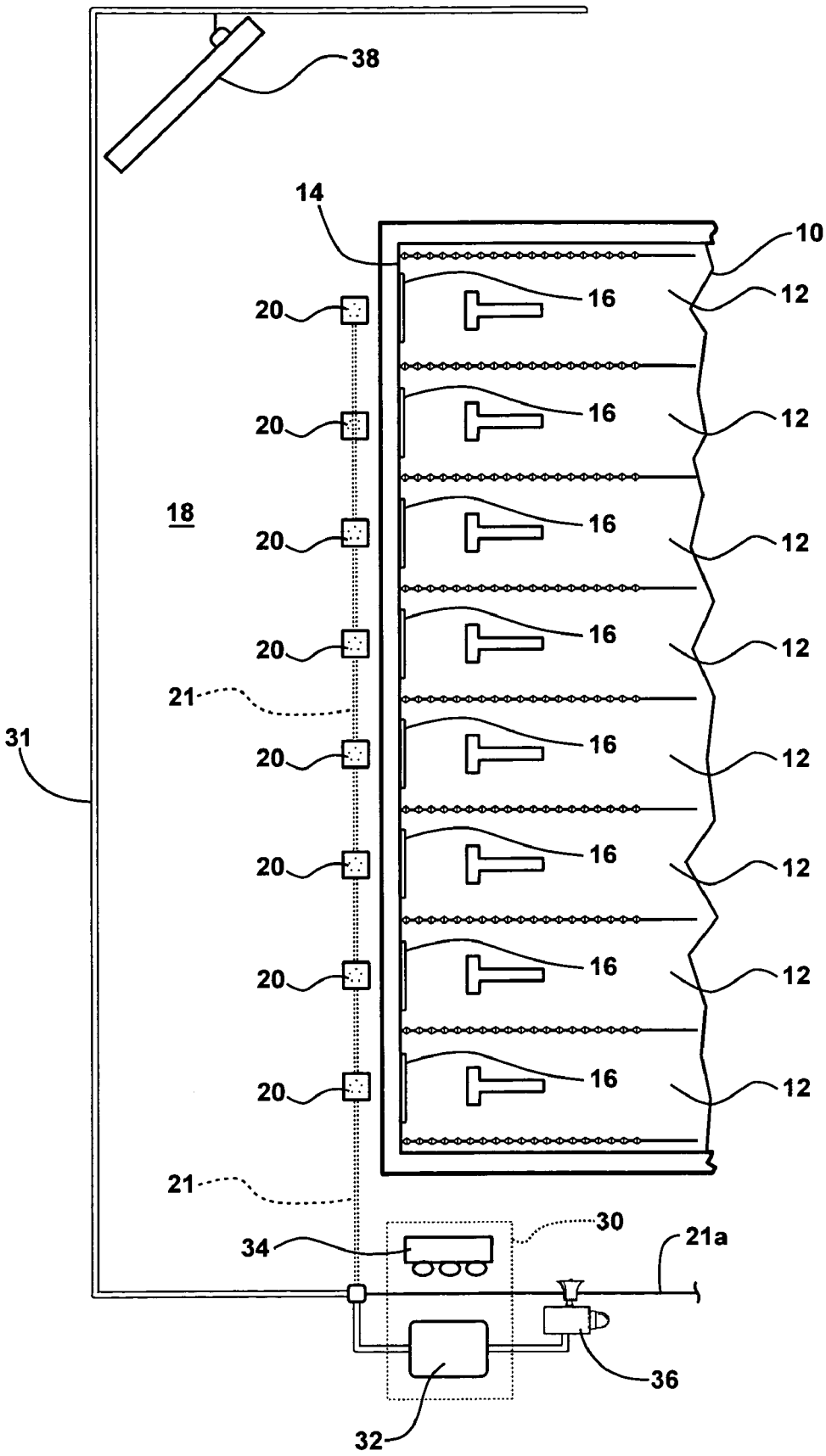
FIG - 1 PRIOR ART
FIG. 1 is a plan view of a typical prior art timing system setup using deck plates mounted in the pool deck.
Figure 1A:
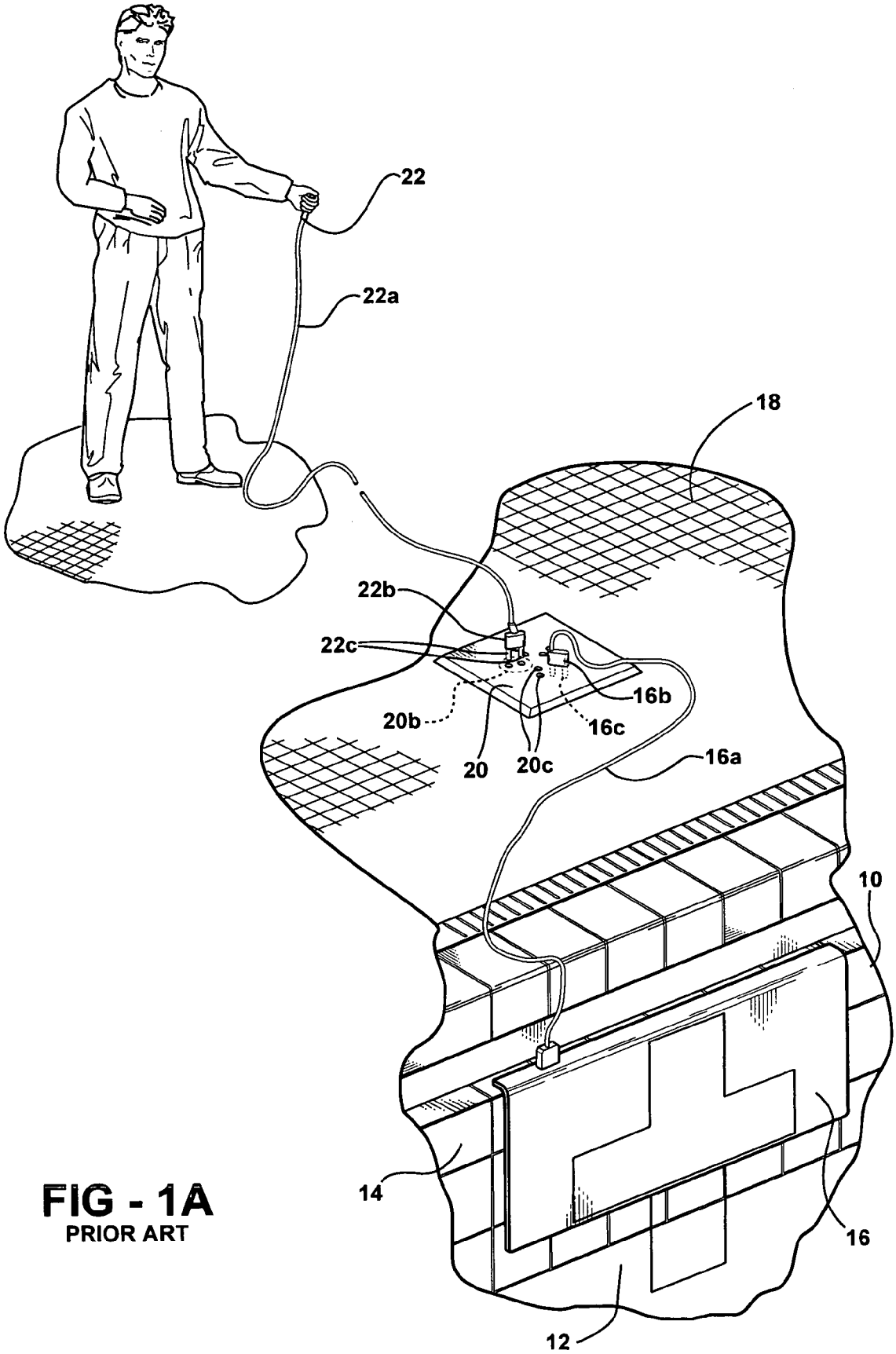
FIG - 1A PRIOR ART
FIG. 1A is a perspective view of the end of one of the swimming lanes from FIG. 1, showing prior art conductive electrical connections between a touchpad, a backup button, and one of the deck plates.
Figure 2:
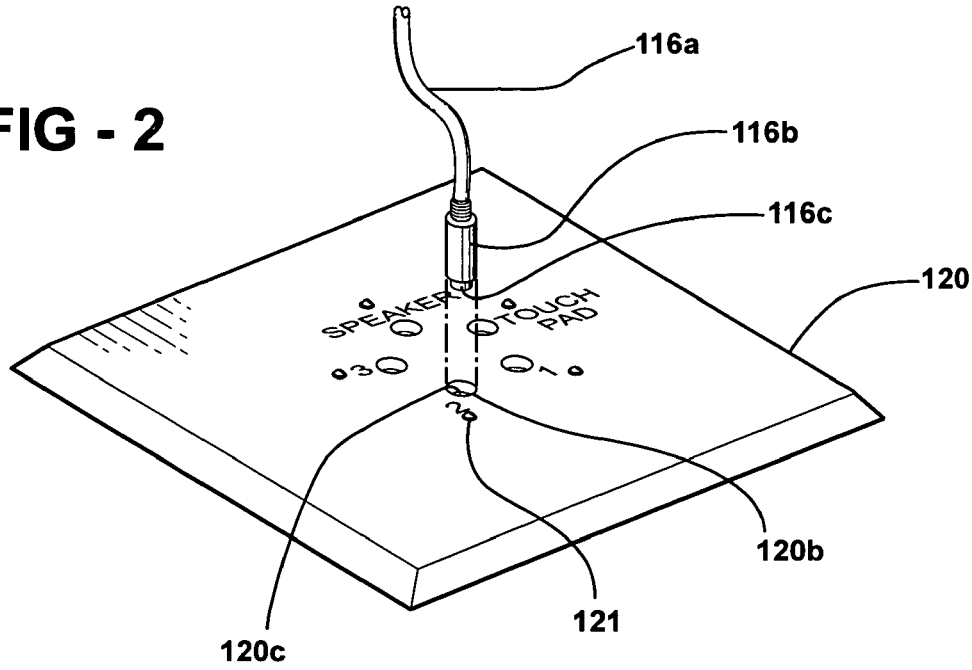
FIG. 2 is a perspective view of a deck plate and a cable from the touchpad with optical connector terminals according to the present invention, with the touchpad terminal separated from its mating deck plate terminal for clarity.

Referring first to FIG. 2, the invention is illustrated in a preferred example in which an optical deck plate 120 receives a mating optical signal cable 116*a* from a poolside signal device such as touchpad 16 or backup button 22. Deck plate 120 includes optical connector sockets 120*b* corresponding in purpose to the multi-terminal electrical sockets shown in FIG. 1A, but having no exposed metal contacts and requiring only a single terminal opening for receiving a one-part optical plug 116*b* at the end of cable 116*a*. The "terminal" of optical plug 116*b* is a photo-transmitter device 116*c* of known type, for example a visible LED light source with a simple on/off signal state. It will be understood by those skilled in the art that other types of photo-transmitter can be used, for example an infrared or other non-visible LED or a laser light source such as an injection laser diode (ILD). Low-cost visible LED type devices are widely available, economical, and currently preferred for their ability to be visually verified.

Although the actual light emitter is shown in the terminal plug portion of cable 116*a*, it will be understood that light could also be transmitted to the terminal end from an upstream source, for example by fiber optics.

Optical connector socket 120*b* in the deck plate includes a photo-receiver device 120*c*, for example a phototransistor device of known type that reacts to an "on" light signal from the LED in the photo-transmitter 116*c* by generating an electrical "hit" signal. Other known types of photo-receiver device can be used, limited only by their compatibility with the signal from the photo-transmitter 116*c*.

FIG. 2 also illustrates optional indicator lights 121 associated with each socket 120*b*, coupled electrically to the output of photo-receivers 120*c* to momentarily light up when an optical signal is received from a touchpad or backup button through cable 116*a*. Indicator lights 121 allow the optical connection to be tested poolside before a race, and during a race gives visual confirmation to the people timing the race that the system is working.

The materials used for cable 116*a* and deck plate 120 are conventional, for example a non-conductive rubber sheath over conductive wiring for the cable, and a hard, wear-resistant, non-conductive plastic for the deck plate.

Figure 3:
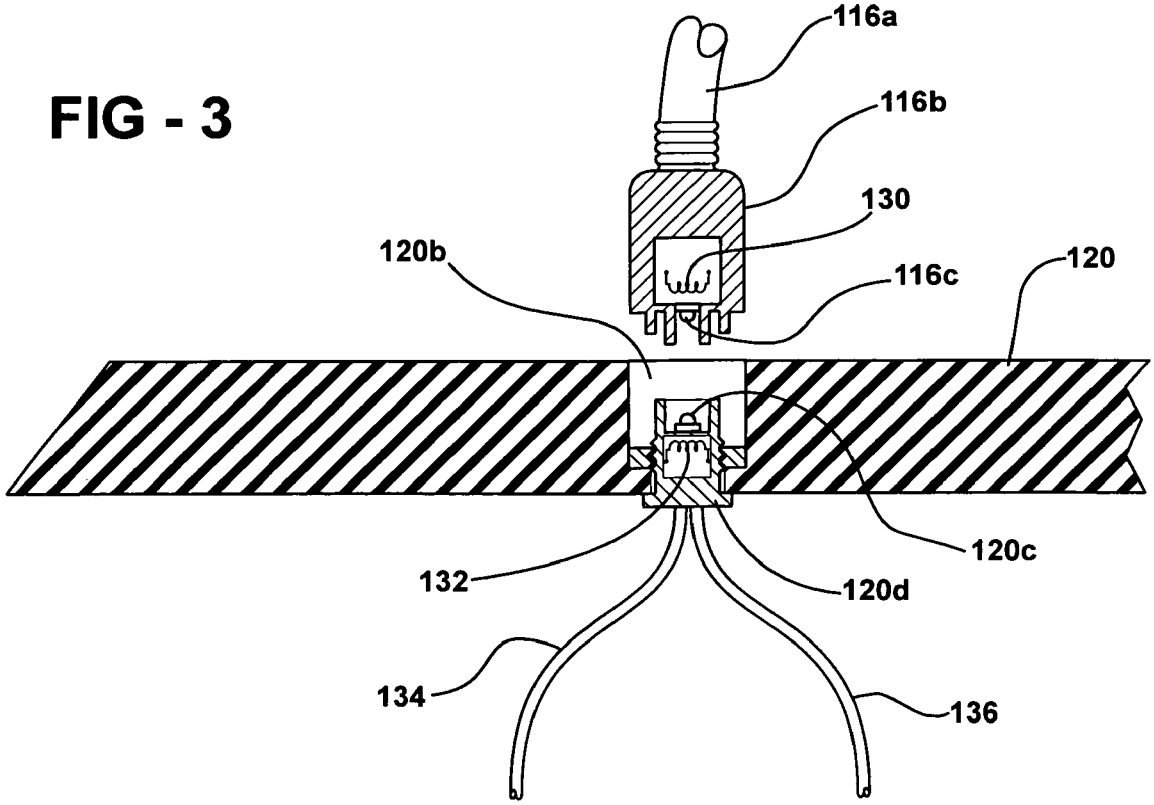
FIG. 3 is a side elevation view, in section, of the separated deck plate and cable terminals of claim 1, with a schematically illustrated inductive power coupling in the terminals.

FIG. 3 shows the optical connection between cable 116*a* and deck plate 120 in more detail. Plug 116*b* is made from a non-conductive material such as plastic or rubber, and schematically shows photo-transmitter 116*c* associated with a power source in the cable, in FIG. 3 a preferred inductive coupling such as a transformer type conductive copper coil 130, sealed in the non-conductive body of the plug. As shown in more detail in FIG. 5, and as will be understood by those skilled in the art, inductive coupling 130 is electrically connected in a circuit with photo-transmitter 116*c* and the touch pad or backup button switch contacts. When the touchpad or backup button switch contacts are closed, power is received inductively by coupling 130 from the deck plate socket and transferred to photo-transmitter 116*c*, which produces a flash of light.

Other known types of inductive or non-metal power coupling might be used to transfer power across the optical connection, but the inductive copper coils shown in the illustrated example are simple, reliable, and currently preferred.

Figure 4:
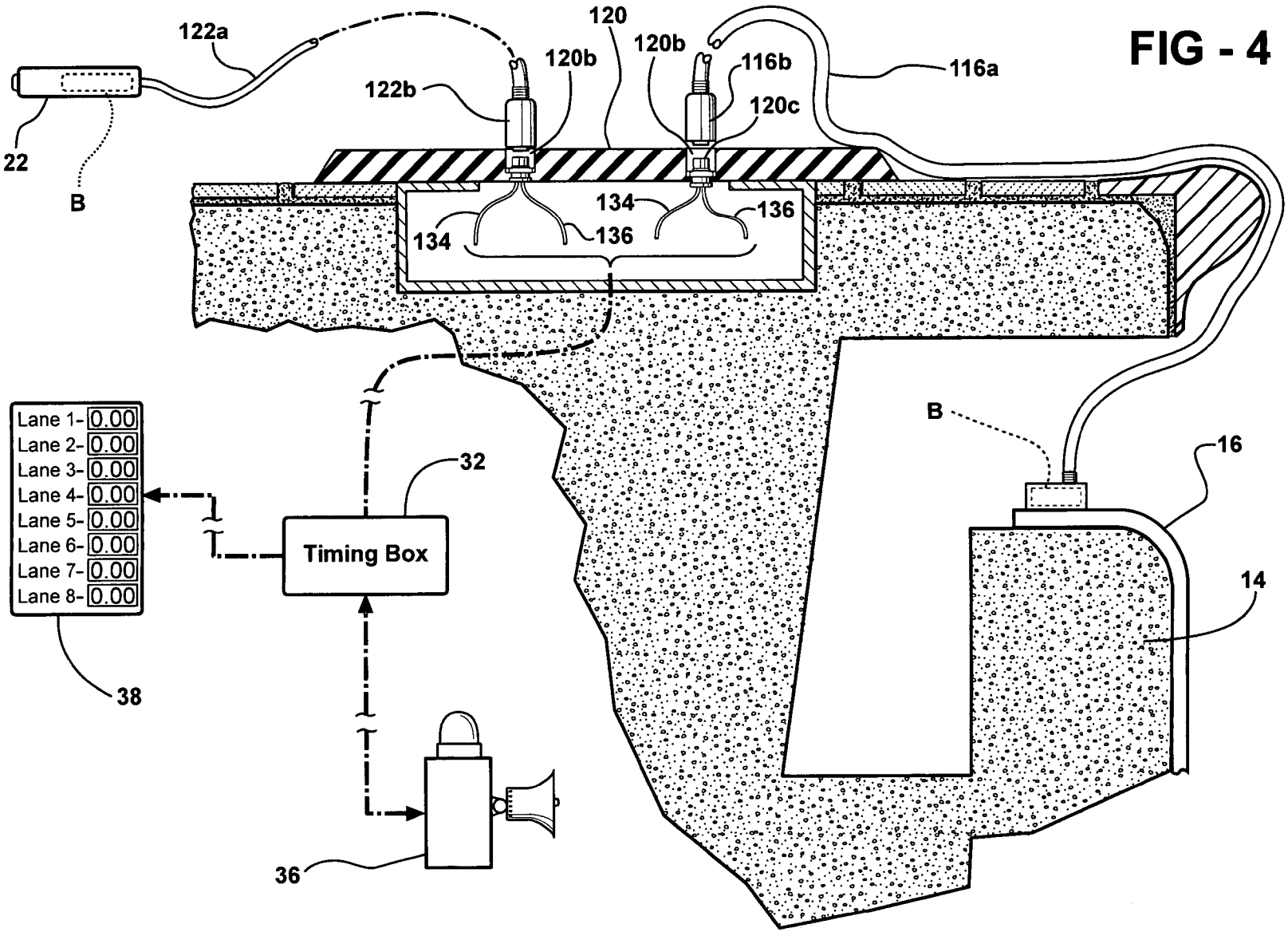
FIG. 4 is a schematic of the deck plate connector system of FIGS. 2 and 3 incorporated into a timing system.

It is also possible to supply power to photo-transmitter 116*c* with a self-contained power source connected to cable 116*a*, for example a small battery housed in the touchpad or backup button and connected through the switch contacts with the photo-transmitter. FIG. 4 shows optional batteries B in hidden lines, located in the backup button 22 and in the touchpad 16.

FIGS. 3 and 4 show photo-receiver terminal 120*c* mounted in socket 120*b* in the deck plate, with an associated inductive power coupling 132. Like photo-transmitter 116*c* and coupling 130 sealed in the touchpad cable, photo-receiver 120*c* and coupling 132 are sealed inside the photo-receiver housing 120*d* or deck plate 120, such that electric current transmitted to or from the coupling and photo-receiver is insulated from the poolside environment. Unlike the electrical circuit between the photo-transmitter 116*c* and coupling 130 in the touchpad cable, deck plate coupling 132 is not electrically connected to photo-receiver 120*c*, but rather to supply wiring 134 from a known type of DC power supply associated with the race timing system. Photo-receiver 120*c* is connected on a separate circuit to wiring 136 that transmits the photo-receiver's optically-generated electrical signals to the timing system in the manner of conventionally-generated electrical signals.

It will be understood by those skilled in the art that inductive coupling 132 need not be built into the optical terminal 120*c* as shown, but could be built into the deck plate adjacent socket 120*b*. It will also be understood that although 120*c* is shown as part of a screw-in terminal, it can be secured removably or permanently in the deck plate in different ways.

If the optical signal from photo-transmitter 116*c* is generated by a power source contained in the touchpad or backup button, the inductive coupling 130 can be omitted from the cable plug, and coupling 132 and power supply wiring 134 can be omitted from the deck plate.

The fit between plug 116*b* and socket 120*b* is preferably light-resistant and water-resistant, to maximize transmission and reception of the optical signal in the socket. In the illustrated embodiment of FIG. 3 this is achieved with an elastomeric plug body 116*b* sized to fit snugly and somewhat resiliently in socket 120*b*. It will be understood that other light-resistant and/or water-resistant connection types can be used, including but not limited to bayonet fittings, threaded fittings, plug fittings with threaded collars, snap-fittings, and the like. The shape and size of socket 120*b* and the manner and orientation in which photo-receiver 120*c* are mounted in the socket can also vary.

Inductive couplings 130 and 132 are brought into sufficient proximity by the mating of plug 116*b* with socket 120*b* (FIG. 4) to inductively generate an electrical current in coupling 130 when an alternating current is passed through coupling 132 from the central power supply. This inductive electrical connection is fully sealed and insulated from the pool-side environment, without any exposed metal terminals, eliminating the corrosion concerns normally associated with poolside signal connections.

FIG. 4 shows both a touchpad 16 and a backup button 22 connected through cables 116*a* and 122*a* to deck plate 120 with optical connections as described above. Power is inductively received by the coupling 130 and stored by a capacitor. Each time a swimmer hits touchpad 16 or a race official hits backup button 22, closing its switch contacts, the capacitor's charge is discharged through photo-transmitter 116*c* in respective plug 116*b* to generate an optical "hit" signal. The hit signal is optically received by the corresponding photo-receiver in deck plate 120, converted to an electrical signal, and transmitted to the timing box 32 to record and display a lap time or race finish in known manner.

It will be understood that although touchpads and backup buttons are the poolside signal devices with which the invention is most likely to be used, other poolside electrical signal devices with terminal connections likely to be inundated with pool water can benefit from the invention.

Figure 5:
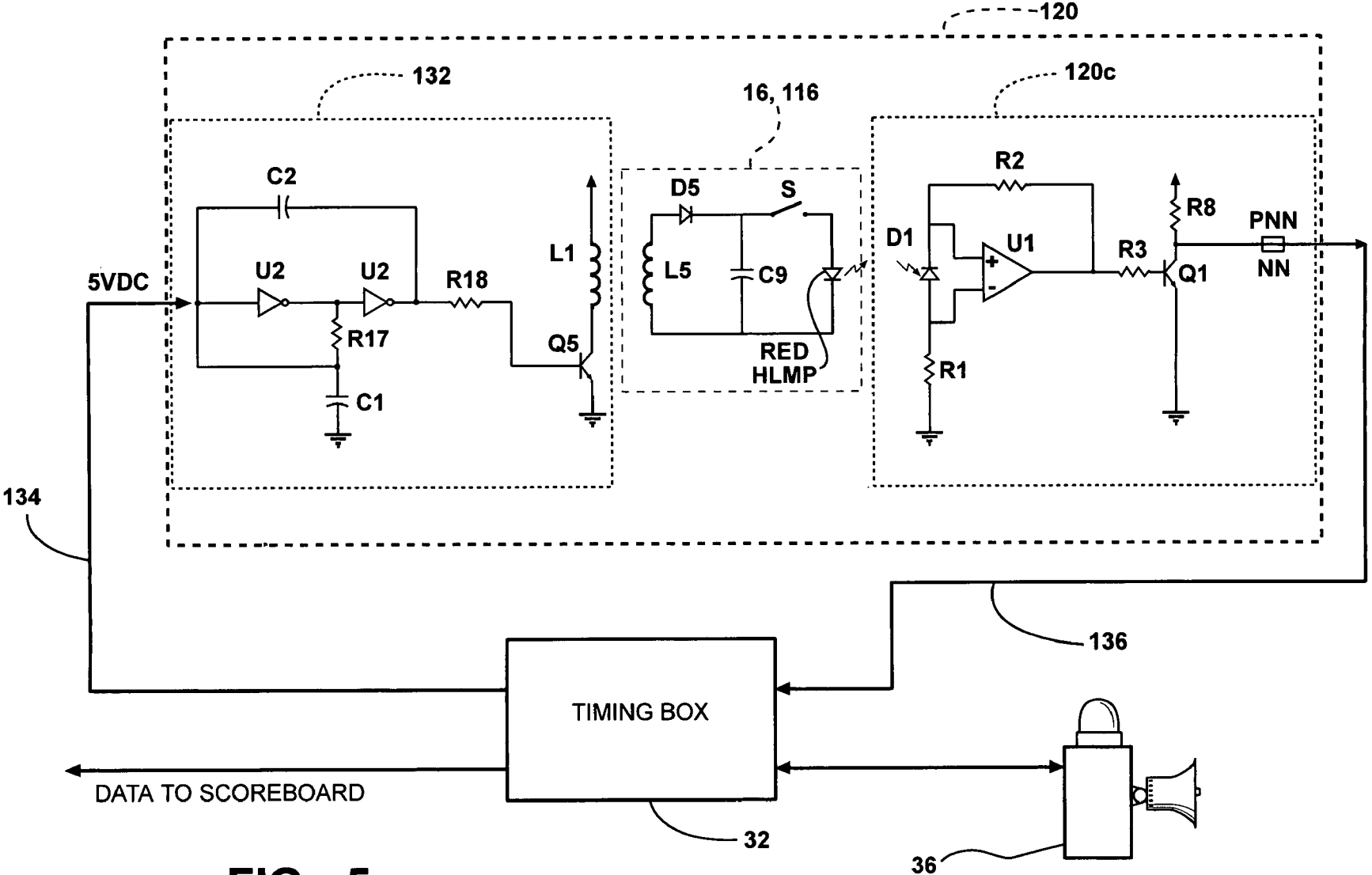
FIG. 5 is a schematic diagram of preferred inductive power supply and optical signal circuits for the connections of FIGS. 3 and 4.

FIG. 5 is a currently preferred schematic circuit diagram of the power supply, switching, inductive coupling, and photo-receiver/transmitter components illustrated in the example above. The circuit labeled 16, 116 represents the touchpad/backup button switching mechanism and the photo-transmitter and cable-side inductive coupling 130; 132 represents the inductive power coupling in the deck plate 120, in the form of an oscillator circuit; and 120*c* represents the photo-receiver in the deck plate, in the form of a phototransistor circuit. The schematic position of circuit 16, 116 relative to the other circuits represents the touchpad cable plug 116*b* plugged into the deck plate socket 120*b*.

In FIG. 5, 5VDC electric current is delivered from the timing box 32 through wiring 134 to oscillator circuit 132. The oscillators U2 are tuned to approximately 1.2 MHz with the components shown. The output of oscillators U2 feeds the medium power E-line transistor Q5 to provide alternating current (AC) sufficient to excite coil L1. The peak-to-peak amplitude of the coil output in the illustrated example is 15-20VAC.

The inductive coupling associated with the photo-transmitter circuit 116*c* has its coil L5 placed sufficiently close to coil L1 to inductively generate a corresponding current. Photo-transmitter coil L5 has more turns than photo-receiver coil L1, resulting in the voltage being stepped up, for example to 20VPPK (high peak power). Diode D5 rectifies the AC current to DC current and capacitor C9 charges up to approximately 7-10 VDC, functioning like a short-term battery. The capacitor C9 voltage provides the DC current needed to fire the HLMP red LED photo-transmitter when the touchpad switch S is closed by a swimmer's contact with the touchpad.

It takes approximately 500 mS to recharge capacitor C9 after energizing it to fire the LED. An option not shown in the schematic of FIG. 5 is a one shot to energize the oscillators U2 for short bursts sufficient in time to recharge the capacitor before the next "hit" but significantly reducing power consumption and eliminating EMI interference, if desired.

Photo-receiver circuit 120*c* is an amplified phototransistor circuit with a photodiode D1, preferably with a fast rated response time on the order of 50 nS, and a quad type op-amp U1 specialized for single supply low voltage operation. Light received from the LED in 116*c* is turned into a low voltage direct current electrical signal (5VDC, for example) by photo-receiver circuit 120*c* in known manner, and is delivered to the timing box 32 to record the swimmer's hit.

It will be understood that the inductively powered photo-transmitter circuit 16, 116 in FIG. 5 can also be fitted in the backup button 22 and its cable and plug portions, with switch S consisting of the switch contacts in the backup button.

It will be appreciated by those skilled in the art that the inductive power supply circuitry of FIG. 5 can be eliminated from the connector system if the photo-transmitter in the touchpad cable or in the backup button cable is powered by a battery contained in the touchpad or backup button. The inductive power coupling between the poolside optical signal-generating device and the optical deck plate is highly preferred, however, since it eliminates the need for battery maintenance and testing, and eliminates the need for a water-resistant battery housing on devices such as the touchpad or the backup button.

It will be further appreciated that the optical signal connection and its associated inductive electrical coupling may be adapted to transfer more than on/off "hit" signals and momentary enabling power between the timing system and poolside signal devices, although the illustrated system is designed specifically to carry out these primary functions. The disclosed embodiments are representative of presently preferred forms of the invention, but are intended to be illustrative rather than definitive of the invention. The scope of the invention is defined by the following claims.

We accordingly claim:

1. A connector system for a poolside race timing system, comprising:

a photoelectric signal receiving junction located at an exposed portion of the pool deck adjacent a swimming lane, the signal receiving junction comprising a first photo-receiver plug terminal including a photo-receiver device electrically sealed from the poolside environment and capable of generating a low voltage direct current signal, the photo-receiver plug terminal being electrically connected to a race timing system;

a poolside signal generating device associated with the swimming lane and comprising a low voltage direct current circuit, the poolside signal generating device further comprising a switch for closing the low voltage direct current circuit, the poolside signal generating device having a temporary cable connection to the signal receiving junction, the cable connection including a photo-transmitter plug terminal with an associated photo-transmitter device powered by low voltage direct current in response to the switch closing the low voltage direct current circuit, and electrically sealed from the poolside environment, the photo-transmitter plug terminal being temporarily matable with the photo-receiver plug terminal at the signal receiving junction to deliver an optical signal to the photo-receiver plug terminal at the signal receiving junction in response to the closing of the signal generating device switch.

2. The connector system of claim 1, wherein the signal receiving junction comprises a deck plate.

3. The connector system of claim 1, wherein the signal receiving junction comprises a deck cable.

4. The connector system of claim 1, wherein the signal generating device comprises a touchpad.

5. The connector system of claim 1, wherein the signal generating device comprises a backup button.

6. The connector system of claim 1, wherein the low voltage direct current for the photo-transmitter device is derived from a non-conductive power coupling between the photo-receiver plug terminal and the photo-transmitter plug terminal at the signal receiving junction when the plug terminals are mated.

7. The connector system of claim 6, wherein the non-conductive power coupling comprises an inductive coupling with a transmitting portion in the signal receiving junction and a receiving portion in the photo-transmitter plug terminal.

8. The connector system of claim 6, wherein the inductive power coupling comprises a transmitter coil in the signal receiving junction associated with the photo-receiver plug terminal, and a receiving coil in the photo-transmitter plug terminal.

9. The connector system of claim 7, wherein the inductive power coupling comprises a DC-AC inverting circuit in the signal receiving junction and an AC-DC converting circuit in the photo-transmitter plug terminal.

10. The connector system of claim 8, wherein the DC-AC inverting circuit in the signal receiving junction comprises an oscillator circuit, and the AC-DC converting circuit comprises a rectifying circuit.

11. The connector system of claim 9, wherein the rectifying circuit includes a charging capacitor.

12. The connector system of claim 1, wherein the photo-receiver device in the signal receiving junction and the photo-transmitter device of the photo-transmitter plug terminal are powered by low-voltage direct electrical current from the race timing system.

13. The connector system of claim 1, wherein the photo-receiver device in the signal receiving junction is powered by low-voltage direct electrical current from the race timing system, and the photo-transmitter device of the photo-transmitter plug terminal is powered by a battery associated with the poolside signal device.

14. A method for transmitting signals from poolside signal devices to a race timing system at a pool deck, comprising the steps of:

generating an electrical signal at the poolside signal device, converting the electrical signal to a corresponding optical signal, and transmitting the optical signal across a temporary, non-conductive optical plug connection at an exposed portion of the pool deck to a photo-receiver in a sealed signal receiving junction at the exposed portion of the pool deck connected to the race timing system.

15. The method of claim 14, wherein the method further comprises the step of converting the optical signal received by the photo-receiver to an electrical signal readable by the race timing system.

16. The method of claim 14, wherein the method further comprises the step of supplying electrical power to the poolside signal device for the electrical signal through the non-conductive optical connection at the pool deck.

17. The method of claim 16, wherein the method further comprises the step of supplying the electrical power through the non-conductive optical connection at the pool deck with an inductive coupling.

* * * * *